US008686328B2

(12) United States Patent
Bugge et al.

(10) Patent No.: US 8,686,328 B2
(45) Date of Patent: Apr. 1, 2014

(54) RESETTABLE MISSILE CONTROL FIN LOCK ASSEMBLY

(75) Inventors: John F. Bugge, Tucson, AZ (US); John D. Willems, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 83 days.

(21) Appl. No.: 13/554,032

(22) Filed: Jul. 20, 2012

(65) Prior Publication Data

US 2014/0021289 A1 Jan. 23, 2014

(51) Int. Cl.

| | |
|---|---|
| ***F42B 10/64*** | (2006.01) |
| ***F42B 10/02*** | (2006.01) |
| ***F42B 15/01*** | (2006.01) |

(52) U.S. Cl.
USPC ..... 244/3.24; 244/3.27

(58) Field of Classification Search
USPC ..... 244/3.24, 3.27–3.29, 3.25, 3.26, 3.3, 244/3.21, 224
See application file for complete search history.

(56) References Cited

U.S. PATENT DOCUMENTS

| | | | | |
|---|---|---|---|---|
| 4,709,877 | A * | 12/1987 | Goulding | 244/3.28 |
| 5,409,185 | A | 4/1995 | Oldakowski | |
| 5,950,963 | A | 9/1999 | Speicher et al. | |
| 6,450,444 | B1 | 9/2002 | Sorvino | |
| 7,316,370 | B2 * | 1/2008 | Sankovic et al. | 244/3.27 |
| 7,700,902 | B2 * | 4/2010 | Mock et al. | 244/3.24 |
| 2006/0278754 | A1 | 12/2006 | Sankovic et al. | |

* cited by examiner

*Primary Examiner* — Tien Dinh
*Assistant Examiner* — Richard R Green
(74) *Attorney, Agent, or Firm* — Renner, Otto, Boisselle & Sklar, LLP

(57) ABSTRACT

A fin lock assembly 12 for locking and unlocking missile fins 20 includes a piston 34 movable along a piston axis 44 between a locked position for preventing a fin from rotating and an unlocked position for allowing the fin to rotate. The fin lock assembly includes a camshaft 46 rotatable between a locked position and a relatively-rotated unlocked position about a cam axis 50 that is transverse the piston axis. The camshaft has an eccentric portion 66 connected to the piston such that rotation of the camshaft between the locked position and the unlocked position moves the piston between its corresponding locked and unlocked positions. The fin lock assembly includes a torsion spring 72 connected to the camshaft to bias the camshaft toward its unlocked position. A latch mechanism 100 holds a plurality of camshafts in their locked positions and simultaneously releases the camshafts to release their fins.

13 Claims, 14 Drawing Sheets

RESETTABLE MISSILE CONTROL FIN LOCK ASSEMBLY

FIELD OF THE INVENTION

The invention relates to a mechanism for locking in place the steering fins of a missile, particularly when the missile is not in use, and more particularly to a resettable mechanism for locking the steering fins.

BACKGROUND

A typical missile includes multiple controllable steering fins spaced around the sides of a missile fuselage. The fins are rotatable to provide aerodynamic steering control during missile flight. The fins are coupled to rotatable shafts that extend into the fuselage and engage corresponding motors, generally through associated gear linkages that control the rotation of the fins.

Accurate flight of the missile depends on the proper function of the steering fins, and it is desirable to avoid damage to the controls when the missile is carried external to an aircraft or during pre-flight handling. Locking the steering fins in place when the missile is not in use reduces the possibility of damage and wear on the steering fins and related components. At the same time, the steering fins must be quickly and reliably released so that they can perform their steering function when the missile is launched.

A typical locking mechanism releases the steering fins through ignition of a small explosive charge. Explosive or pyrotechnic charges, even small ones, require special handling and care to ensure safety and reliability, but act quickly and typically enable the unlocking mechanism to be relatively small and compact.

SUMMARY OF THE INVENTION

The present invention provides a missile fin locking mechanism that can be repeatedly locked and unlocked as effectively as and without a pyrotechnic or explosive material.

More particularly, the present invention provides a fin lock assembly for locking and unlocking rotatable missile fins. The fin lock assembly comprises a piston lock assembly that includes a piston that is movable along a piston axis between a locked position for preventing a fin from rotating and an unlocked position for allowing the fin to rotate. The piston lock assembly further includes a camshaft that is rotatable between a locked position and a relatively-rotated unlocked position about a cam axis that is transverse the piston axis. The camshaft has an eccentric portion that is connected to the piston such that rotation of the camshaft between the locked position and the unlocked position moves the piston between its corresponding locked position and unlocked position. The piston lock assembly also includes a torsion spring connected to the camshaft to bias the camshaft from its locked position toward its unlocked position.

A missile typically has a plurality of control fins. Consequently, the fin lock assembly provided by the present invention typically employs a plurality of piston lock assemblies, each piston lock assembly being associated with a respective control fin. The fin lock assembly provided by the invention further includes a latch mechanism that holds the piston lock assemblies in their locked condition, preventing the control fins from rotating, and can simultaneously release all of the piston lock assemblies to allow them to move to their unlocked conditions and allow the control fins to rotate.

Thus the present invention also can be described as providing a fin lock assembly for locking and unlocking rotatable missile fins that comprises a plurality of piston lock assemblies and a latch mechanism. The piston lock assembly includes a piston movable along a piston axis between a locked position for preventing a fin from rotating and an unlocked position for allowing the fin to rotate, and a camshaft rotatable about a cam axis transverse the piston axis between a locked position and a relatively-rotated unlocked position. The piston includes a piston portion for interfering with the rotation of the fin and a base portion for connecting the piston portion to the camshaft. The camshaft has an eccentric pin at a distal end that is connected to the base portion of the piston such that rotation of the camshaft between the locked position and the unlocked position moves the piston between its corresponding locked position and unlocked position. The camshaft further includes a torsion spring connected to the camshaft to bias the camshaft toward its unlocked position. A proximal end of the camshaft has a radial notch that forms a shoulder on one side and a relieved portion on an opposite side. The latch mechanism includes a rotatable latch member having a spring leg with a tang on a distal end of the spring leg that engages the shoulder of the camshaft to hold the camshaft in its locked position. The rotatable member has a circumferential slot that receives an eccentric control shaft. The circumferential slot has a locked portion and an unlocked portion separated by a restriction, and the control shaft is rotatable between a locked position where the control shaft cannot pass the restriction and an unlocked position where control shaft can pass the restriction and thereby allow the rotable member to rotate. When the rotatable member is permitted to rotate, the torsion spring of each camshaft simultaneously rotates both a corresponding camshaft and collectively rotates the rotatable member. Rotation of the camshaft moves the corresponding piston to its unlocked position, simultaneously freeing all of the control fins to operate.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

DETAILED DESCRIPTION

Figure 1:
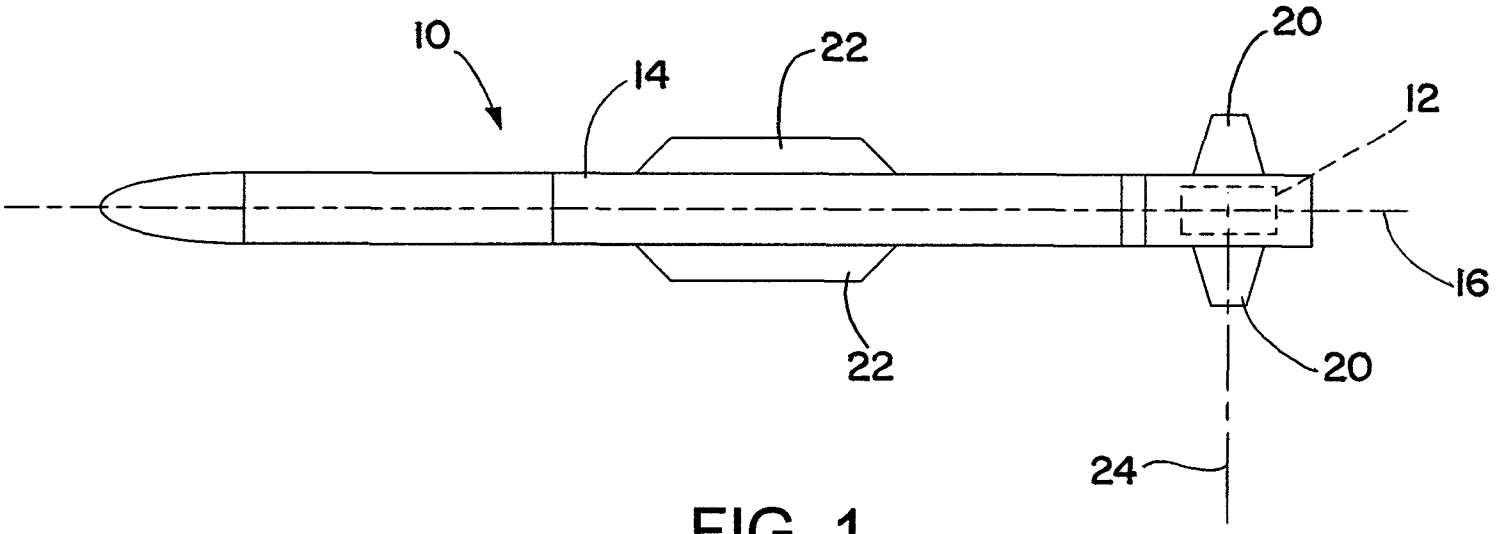
FIG. 1 is a plan view of a missile incorporating a fin lock assembly provided by the present invention.
Figure 2:
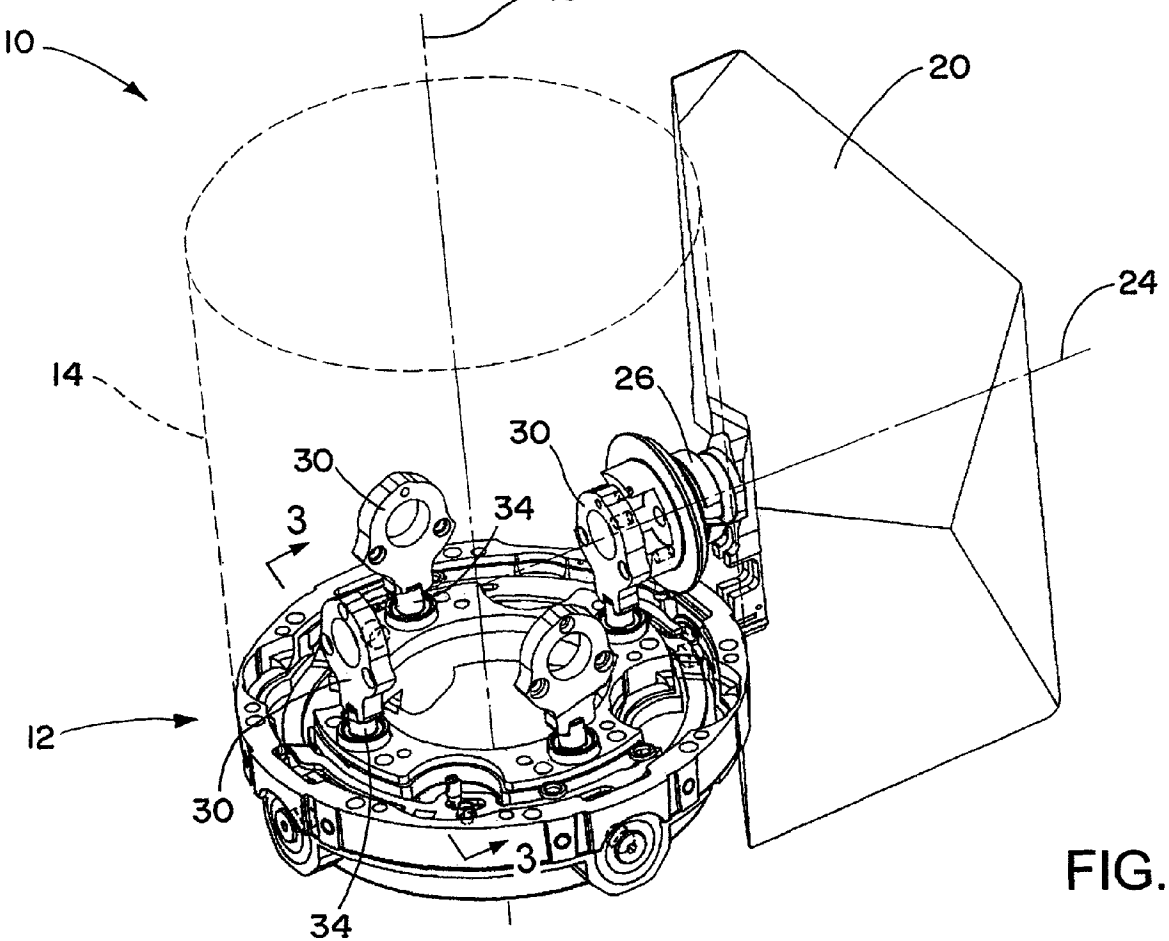
FIG. 2 is a perspective view of an exemplary fin lock assembly provided in accordance with the present invention in a section of a missile body.

Referring now to the drawings in detail, and initially to FIGS. 1 and 2, an example of a missile 10 in which a locking mechanism or fin lock assembly 12 provided by the invention may be employed is shown. The missile 10 generally has a cylindrical body 14 with a longitudinal axis 16. Multiple fins 20 and 22 extend from the surface of the body 14 to help control the missile's path during its flight. In particular, the missile 10 includes a plurality of movable steering control fins 20 toward a rear end of the missile 10 that are rotatable about a fin axis 24 transverse the longitudinal axis 16, and typically perpendicular to the longitudinal axis 16. A typical steering control fin 20 has an output shaft 26 that extends into the missile body 14 and defines the fin axis 24. Rotating this shaft 26 controls the attitude of the steering control fin 20 relative to the longitudinal axis 16 of the missile 10.

The plurality of steering control fins 20 can each be held in a locked, unmoving condition by the fin lock assembly 12. In the illustrated embodiment, referring now to FIGS. 2 and 3, the control fins 20 are connected to the fin lock assembly 12 by a fin lock bracket 30. A separate fin lock bracket 30 is secured to the output shaft 26 of each steering control fin 20 for rotation therewith. The fin lock bracket 30 has a locking recess or detent 32 for receipt of a locking piston 34, also referred to as a fin lock piston (described in further detail below). When the locking piston 34 extends into the recess 32 in the fin lock bracket 30, the output shaft 26, and thus the control fin 20, is locked in place and prevented from rotating. Alternatively, the locking piston may have a notch or recess for receipt of a protrusion formed by the fin lock bracket 30, the output shaft 26, or the fin 20 itself. The fin lock piston 34 is retractable to allow the fin lock bracket 30, and thus the output shaft 26 and the control fin 20, to rotate. The fin lock bracket 30 can be integrated into the output shaft 26, or a recess can be formed in the output shaft 26 in place of a separate fin lock bracket to reduce the number of parts. As shown in the illustrated embodiment, however, the fin lock bracket 30 spaces contact with the locking piston 34 from the output shaft 26. So if the recess 32 in the fin lock bracket 30 is incorporated into the output shaft 26, the fin lock assembly 12 will have to be adjusted to reach the output shaft 26.

Figure 3:
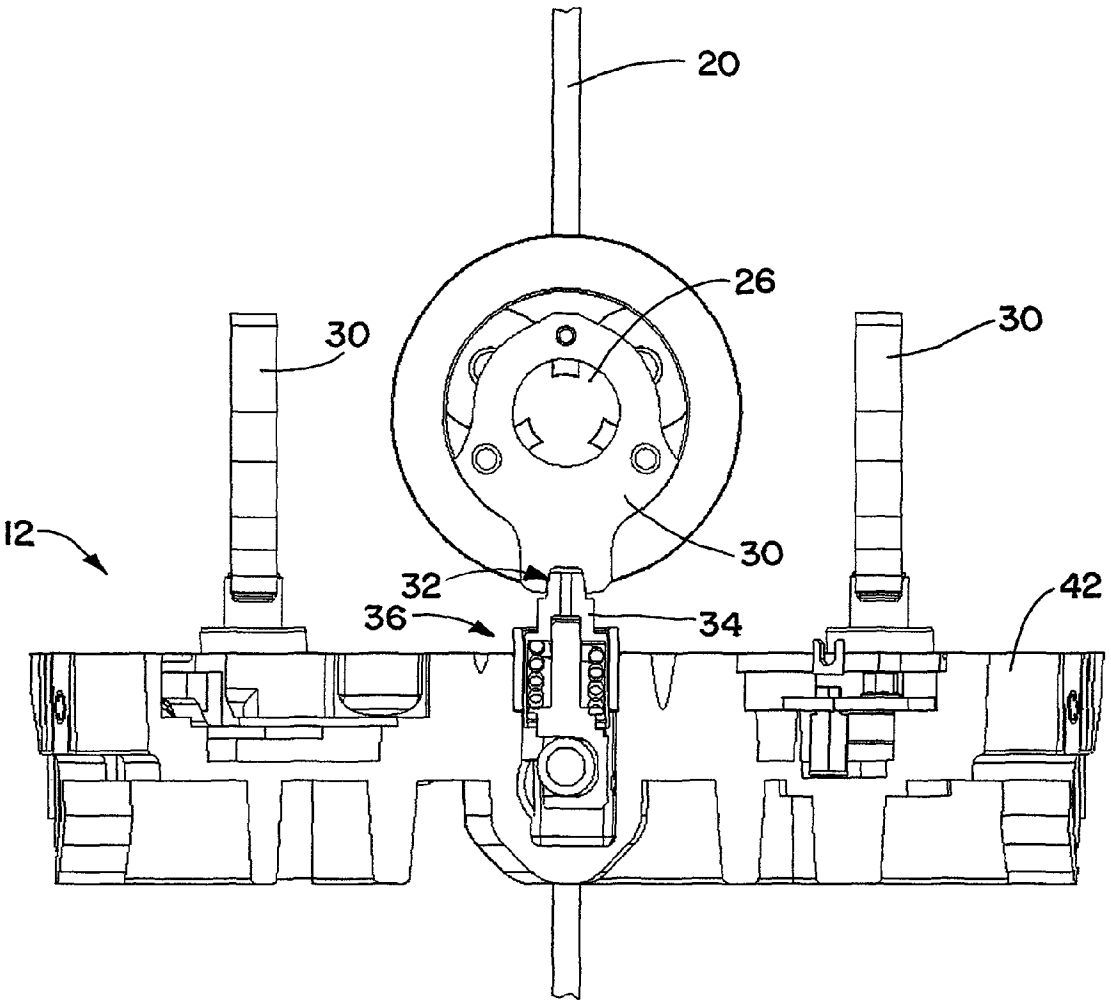
FIG. 3 is an cross-sectional view of the fin lock assembly of FIG. 2 as seen along lines 3-3.
Figure 4:
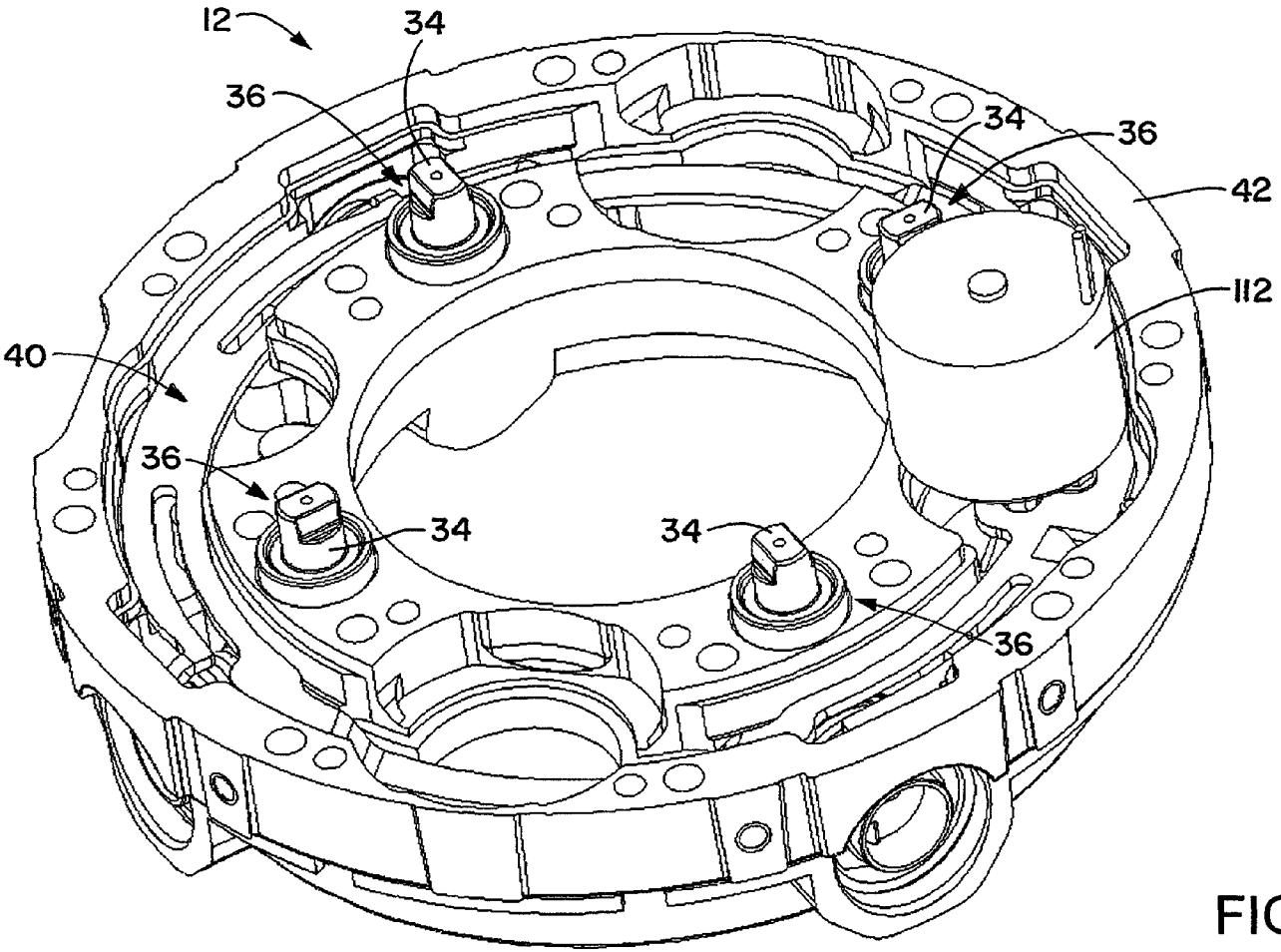
FIG. 4 is a perspective view of the fin lock assembly of FIG. 2.
Figure 5:
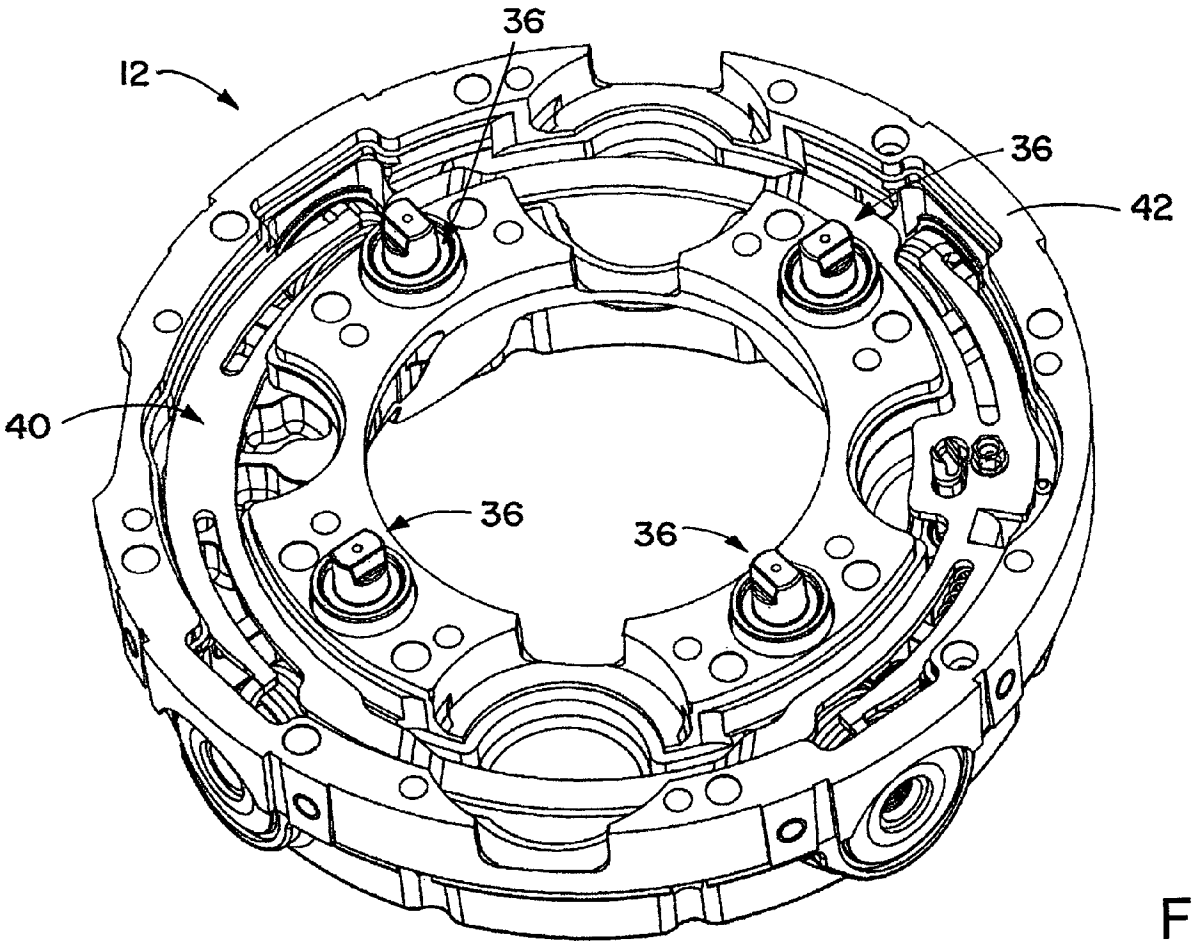
FIG. 5 is another perspective view of the fin lock assembly of FIG. 2.
Figure 6:
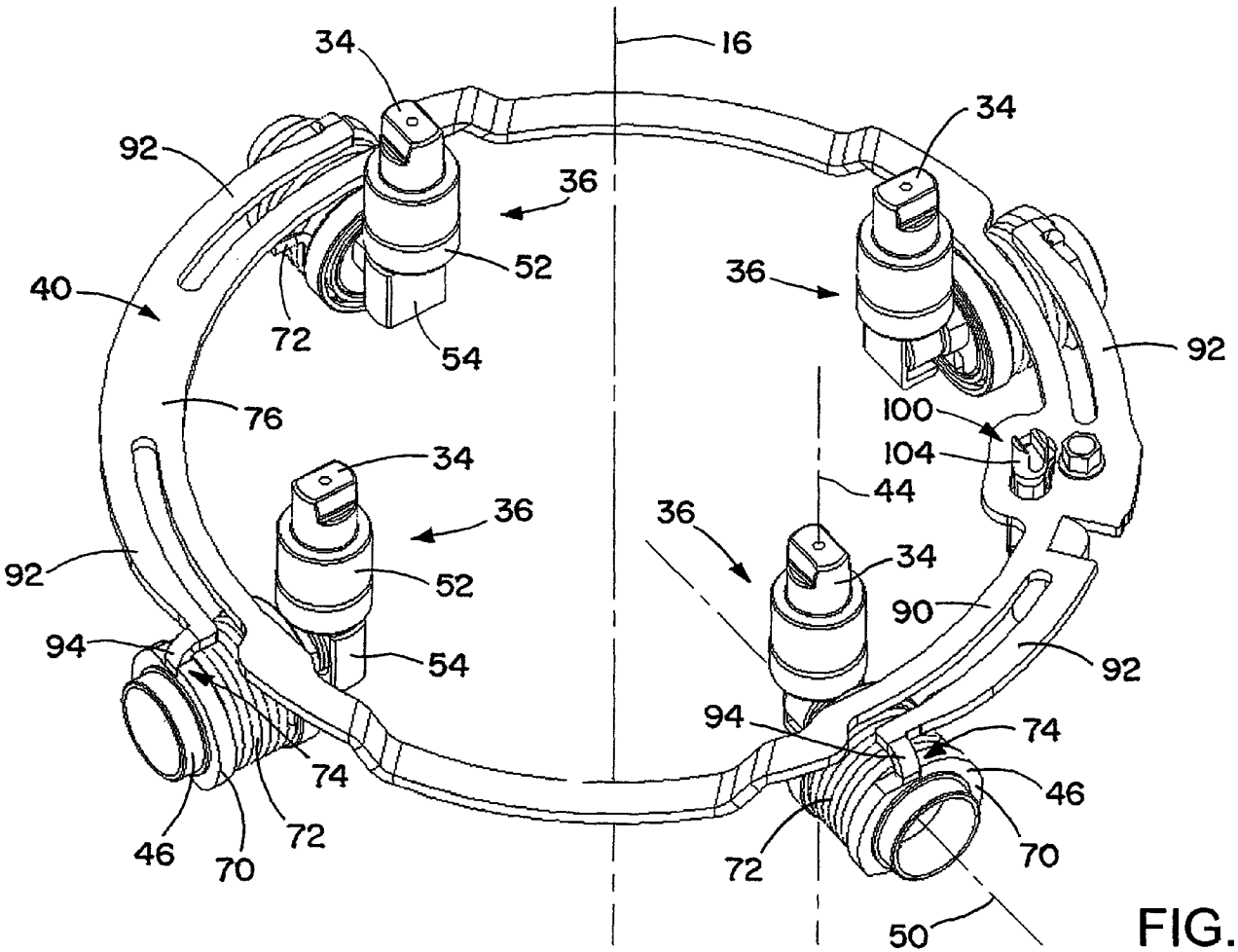
FIG. 6 is a perspective view of a plurality of piston lock assemblies and a latch mechanism portion of the fin lock assembly of FIG. 2.
Figure 7:
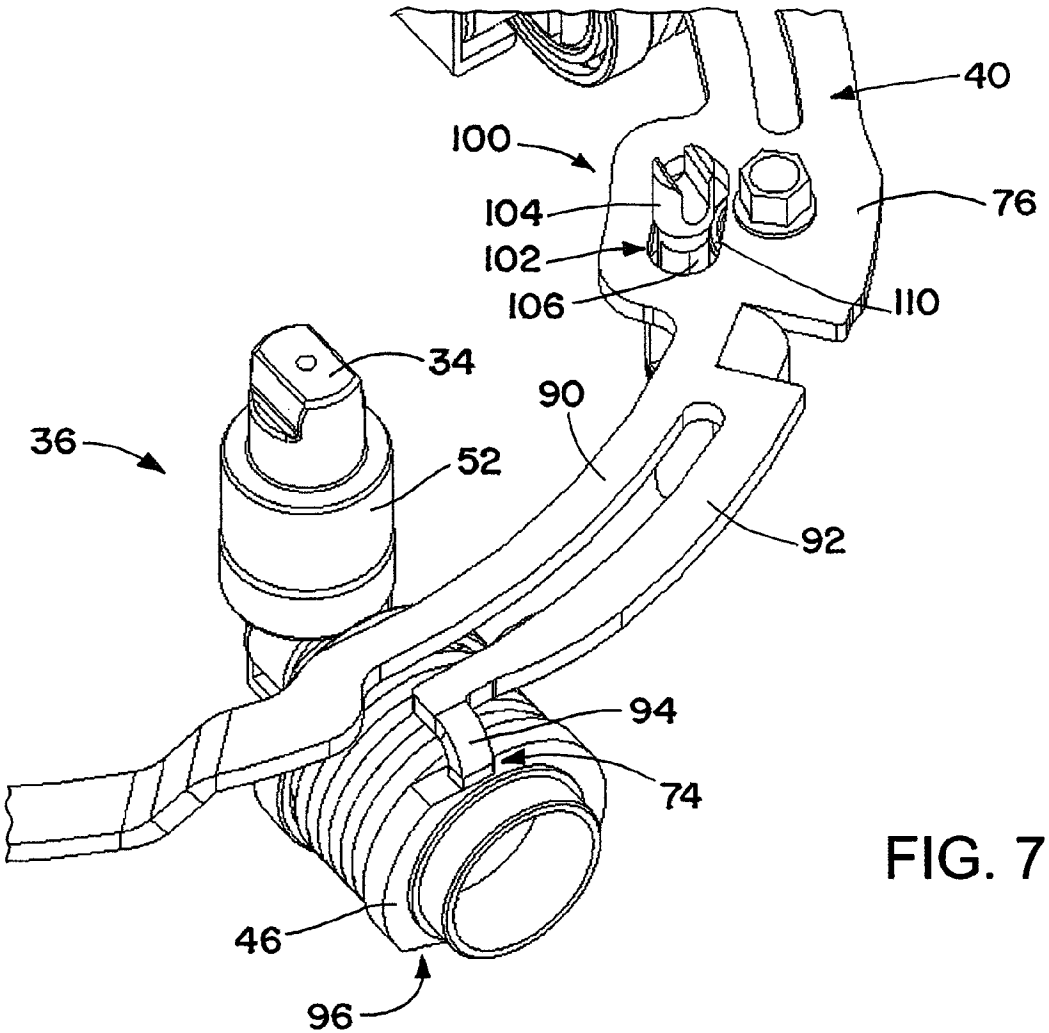
FIG. 7 is an enlarged view of a portion of FIG. 6, including a piston lock assembly.
Figure 9:
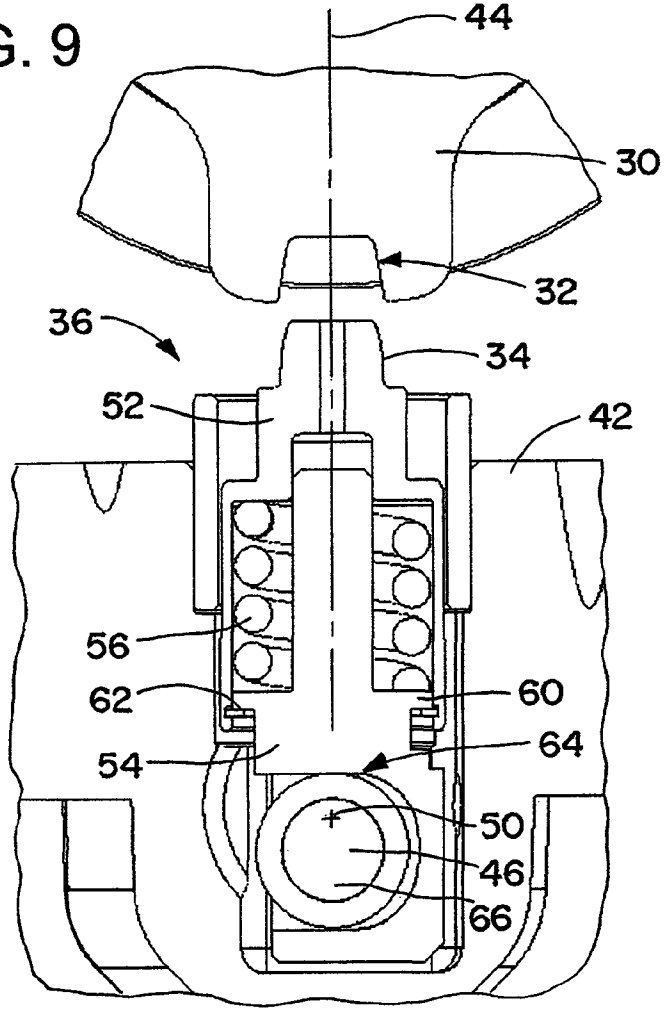
FIGS. 8 and 9 are cross-sectional views of a piston lock assembly in a locked position and an unlocked position, respectively.

An exemplary fin lock assembly is shown in FIGS. 3-5. The fin lock assembly 12 includes a respective piston lock assembly 36 for each of the plurality of steering control fins 20, a latch mechanism 40 for holding each of the plurality of piston lock assemblies 36 in a locked condition until released, and a housing 42 that supports the plurality of piston lock assemblies 36 and the latch mechanism 40. In the locked condition, the piston lock assembly 36 holds the corresponding control fin 20 in a locked position. The latch mechanism 40 can simultaneously release all of the piston lock assemblies 36 to allow each piston lock assembly 36 to move to an unlocked condition. The fin lock assembly 12 can be assembled as a unit, and then mounted in the missile body 14 (FIG. 2) and connected to each of the fins 20.

As shown in FIGS. 6-9, each piston lock assembly 36 includes the locking piston 34 mentioned above, which is axially movable along a piston axis 44, and a camshaft 46, which is rotatable about a cam axis 50 transverse, and typically perpendicular, to the piston axis 44. The piston 34 is movable along the piston axis 16 between a locked position (FIG. 8) for preventing a fin 20 (FIG. 2) from rotating and an unlocked position (FIG. 9) for allowing the fin 20 to rotate.

In the illustrated embodiment, the locking piston 34 includes a piston portion 52 with a distal end shaped for wedged insertion into the locking recess 32 in the fin lock bracket 30, and a base portion 54 that couples the locking piston 34 to the camshaft 46. Although the piston portion 52 and the base portion 54 are separate parts in the illustrated embodiment, they could be combined into a single unit.

Figure 8:
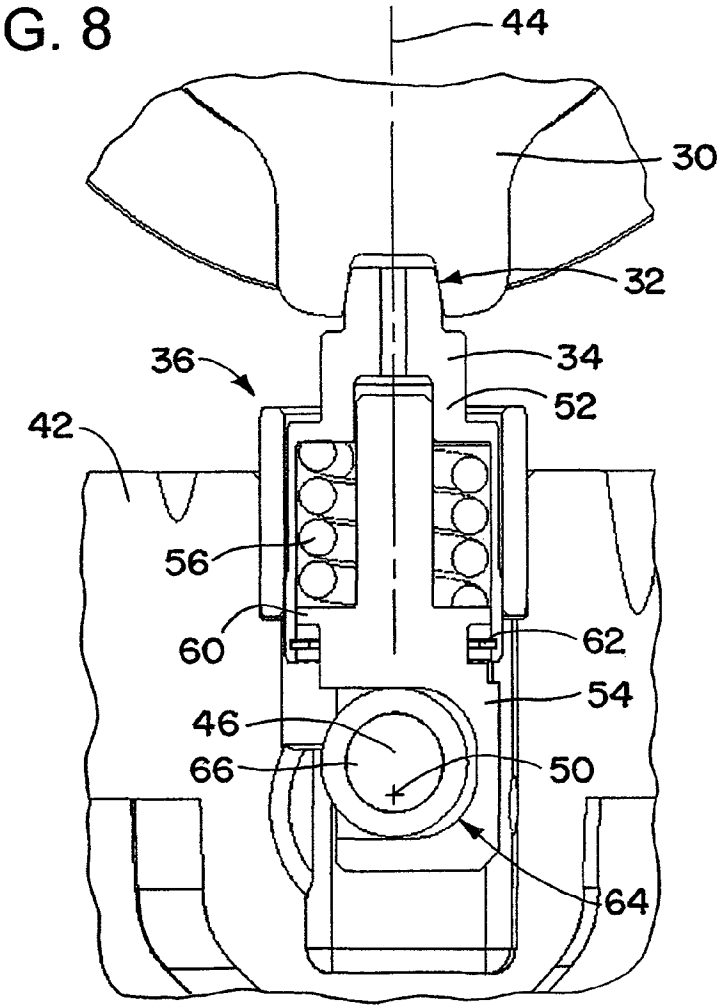

The piston portion 52 is hollow for telescopic receipt of a coil spring 56 interposed between the piston portion 52 and the base portion 54. This arrangement ensures that the piston portion 52 is biased into engagement with the locking recess 32 in the fin lock bracket 30 in the locked condition (FIG. 8) and helps to accommodate tolerance variations to ensure close receipt of the piston portion 52 in the locking recess 32. The base portion 54 is telescopically received in the hollow piston portion 52. Depending on the gap between the distal end of the piston portion 52 and the bottom of the locking recess 32, a gap also may exist between the distal end of the base portion 54 and an inner end wall of the piston portion 52. This gap is smaller than the depth of the locking recess 32, however, so that when the base portion 54 is held at the limit of its forward extension (i.e., when the piston 34 is in a locking position, as shown in FIG. 8), even when the spring 56 is completely compressed the piston portion 52 cannot completely withdraw from the locking recess 32.

The base portion 52 includes a shoulder 60 that is closely received in the piston portion 52. A snap ring 62 or other feature secured to the piston portion 52 retains the base portion 54 in contact with the piston portion 52 even while the spring 56 is attempting to push them apart. The snap ring 62 is received in a circumferential groove in the hollow piston portion 52 to reduce the diameter of the passage in the hollow piston portion 52 and thereby cooperate with the shoulder 60 of the base portion 54 to retain the base portion 54 relative to the piston portion 52. When the base portion 52 is retracted, the shoulder 60 of the base portion 52 engages the snap ring 62 and pulls the piston portion 52 from the locking recess 32. The base portion 52 is retracted through rotation of the camshaft 46, a portion of which is captured in an aperture 64 defined by the base portion 52. The base portion 52 thus acts as a cam follower. In the illustrated embodiment, the proximal end of the base portion 52 has a C-shape structure that defines the aperture 64 and captures the portion of the camshaft 46.

The camshaft 46 is rotatable about the cam axis 50 between a locked position and a relatively-rotated unlocked position. The camshaft 46 has a cam pin portion 66 extending through a bushing 68, eccentrically mounted relative to the cam axis 50. A distal end of the cam pin portion 66 is connected to the piston 34, more particularly the cam pin 66 engages aperture 64 in the base portion 52 of the piston 34. Rotation of the camshaft 46 rotates the eccentric cam pin 66 between the locked position and the unlocked position and moves the base portion 52 along the piston axis 44 between its corresponding locked position and unlocked position. Rotation of the cam pin 66 thus causes the piston portion 52 to engage and disengage the locking recess 32 in the fin lock bracket 30. The camshaft 46 has a cam 70 on a proximal end thereof to which the cam pin 66 is connected.

The fin lock assembly 12 further includes a torsion spring 72 connected to the camshaft 46 to bias the camshaft 46 toward its unlocked position. More particularly, the torsion spring 72 is mounted between the housing 42 of the fin lock assembly 12 and the camshaft 46. The spring potential in this torsion spring 72 provides the energy used to unlock the fins 20. In the illustrated design, a relatively low torsion spring force is needed to very rapidly unlock the control fins 20 (FIG. 2). The cam 70 has a shoulder or heel 74 that is used to hold the cam 70 in a locked position and to prevent the camshaft 46 from rotating to the unlocked position and thereby retracting the piston portion 52 from the recess 32 in the fin lock bracket 30.

Each piston lock assembly 36 is releasably held in a locked state or position by the latch mechanism 40. The latch mechanism 40 includes a rotatable member 76 that engages the camshaft 46, and particularly the heel 74 of the cam 70, to hold the camshaft 46 in its locked position. The latch mechanism 40 is connected to all of the piston lock assemblies 36, and rotation of the rotatable member 76 allows all of the piston lock assemblies 36 to simultaneously unlock their respective fins 20 (FIG. 2). The rotatable member 76 includes a substantially planar ring portion 90 that lies in a plane that is transverse to and generally perpendicular to the longitudinal missile axis 16 and so the rotatable member 76 generally is referred to as the latch ring 76. The latch ring 76 has multiple spring leg portions 92 extending from the ring portion 90 to engage respective piston lock assemblies 36. Each spring leg portion 92 is substantially coplanar with the ring portion 90 but has a tang 94 at a distal end that extends out of the plane to engage the heel 74, which is formed by a radial notch in the respective cam 70. The notch forms the heel 74 on one side and a relieved portion on an opposite side. When the latch ring 76 is in a locking position, the tang 94 on the spring leg 92 prevents the cam 70 from rotating, and thus maintains the piston portion 52 of the piston lock assembly 36 in the locked position. A flat surface 96 in the cam 70 rotationally-spaced from the notch that forms the heel 74 against which the tang 94 sits in the locked position provides a continuous surface on which the tang 94 can ride unimpeded when the cam 70 is rotated back to its locked position.

The latch mechanism 40 also includes a releasable retaining device 100 for preventing rotation of the latch ring 76. In the illustrated embodiment, the retaining device 100 includes a circumferential slot 102 in the latch ring 76 through which an eccentric interface shaft 104 extends. The eccentric shaft 104 is rotatable between a locked position that prevents rotation of the latch ring 76 and an unlocked position that allows rotation of the latch ring 76. The interface shaft 104 has a major diameter that generally corresponds to the width of the slot 102, but the shaft 104 has a flat 106 on one side to provide a reduced diameter. A bearing 110 is mounted to the latch ring 76 to protrude into the extent of the slot 102, thereby narrowing the slot 102 and forming a restriction. As a result, the interface shaft 104 can only pass the bearing 110 when the flat portion 106 of the shaft 104 is rotated to narrow the effective diameter of the shaft 104.

A motive device 112, such as the illustrated solenoid (FIG. 4), can be used to rotate the interface shaft 104 to its unlocked position and allow the latch ring 76 to rotate to its unlocked position. The same motive device can be used to rotate the interface shaft to its locked position, or the interface shaft can be manually rotated to its locked position. The latch mechanism 40 also can have a spring (not shown), such as a torsion spring, associated therewith to bias the latch ring 76 toward a locked position to help reset the latch mechanism, or the latch ring 76 can be manually returned to the locked position.

In operation, the combined efforts of the torsion springs 72 of each piston lock assembly 36, through the respective cams 70, act on the tangs 94 of the spring-leg portions 92 of the latch ring 76 to rotate the latch ring 76 to its unlocked position. Naturally, the torsion springs 72 also rotate the cams 70 and the cam pins 66 to retract the piston portions 52 from their locked positions to their unlocked positions and thereby unlock the fins 20 (FIG. 2).

Figure 11:
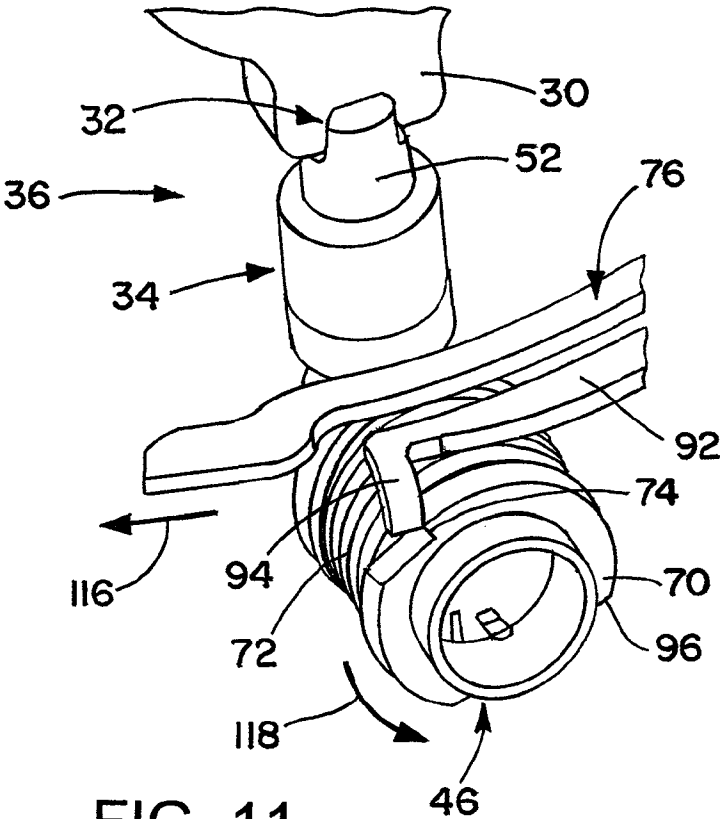
FIG. 11 is a perspective view of a portion of the fin lock assembly in a locked condition.
Figure 10:
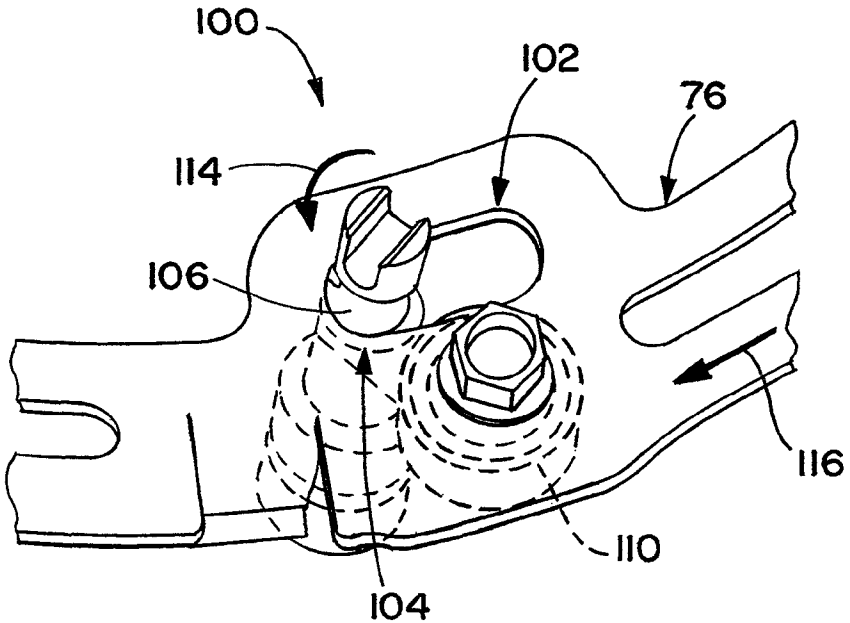
FIG. 10 is a perspective view of a retaining device portion of the latch mechanism portion of the fin lock assembly in a locked condition.
Figure 12B:
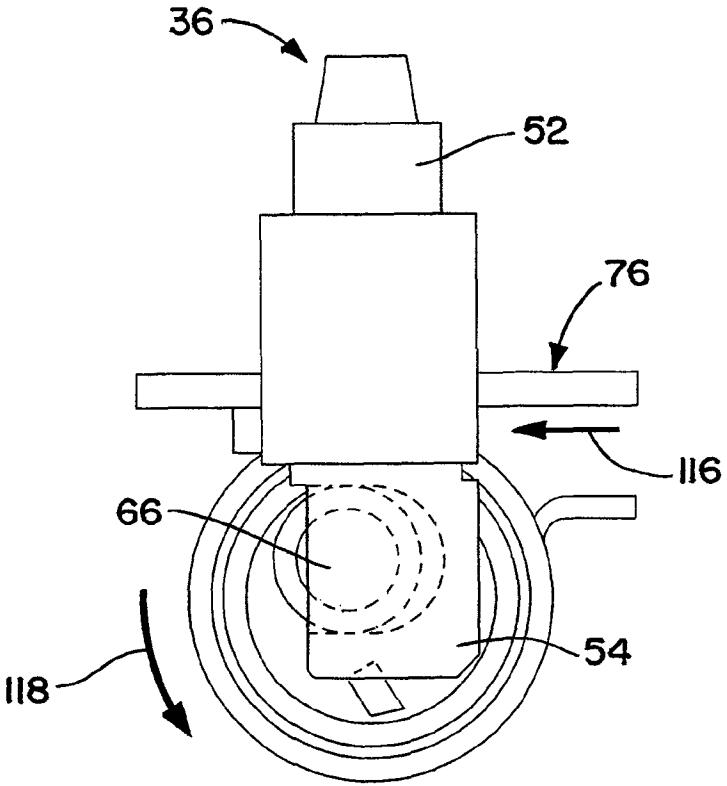
FIGS. 12A-12E are sequential cross-sectional views of the fin lock assembly as it moves from a locked condition to an unlocked condition.
Figure 12A:
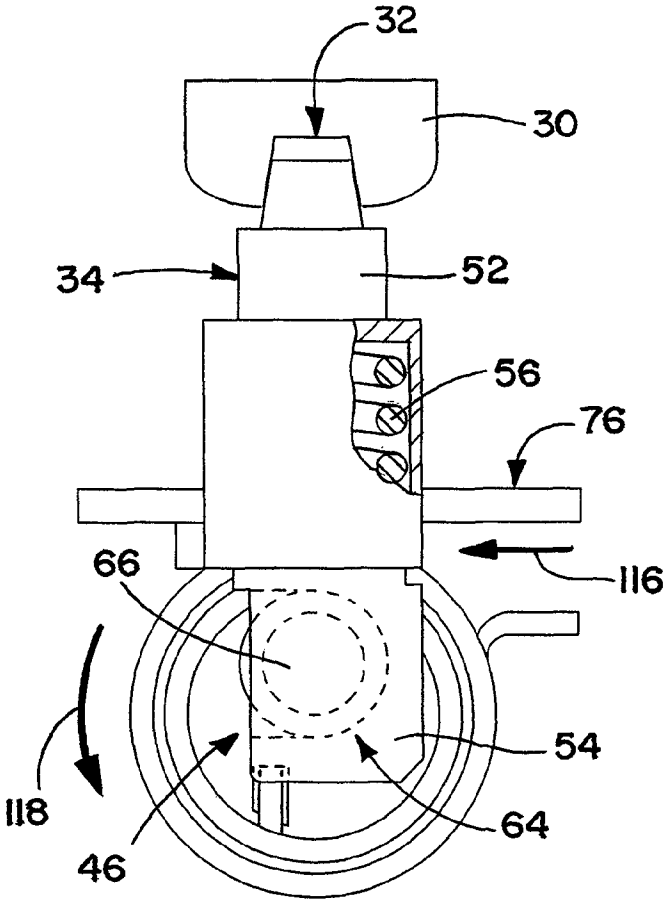
Figure 12E:
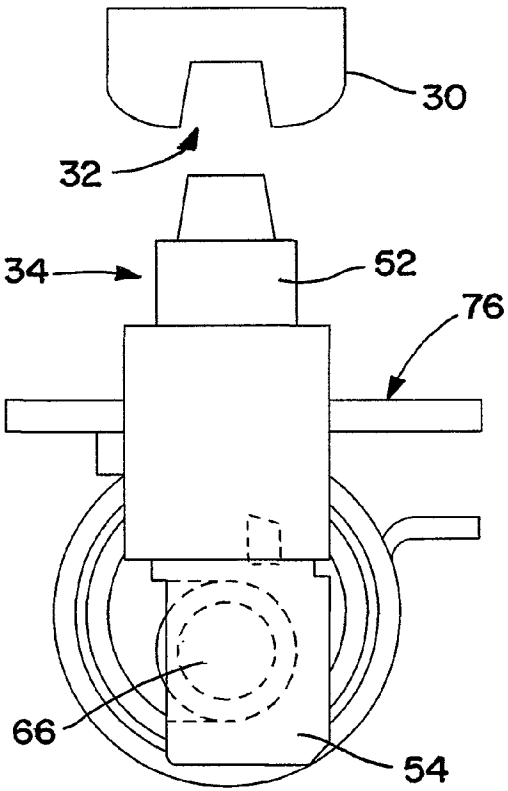
Figure 12D:
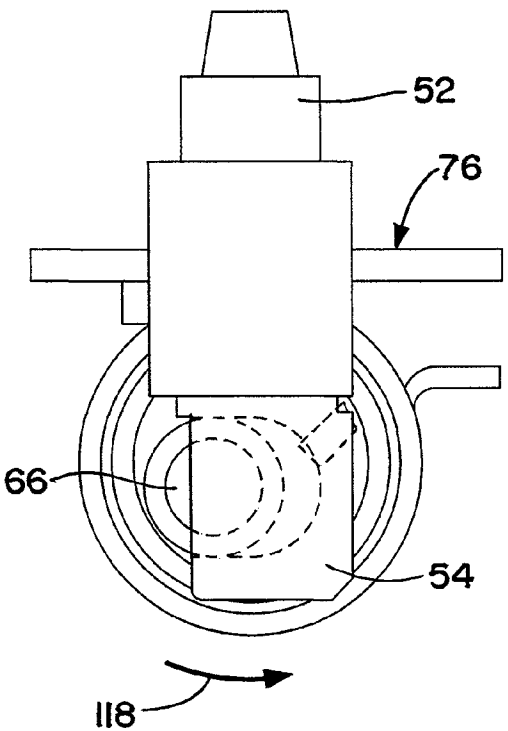
Figure 12C:
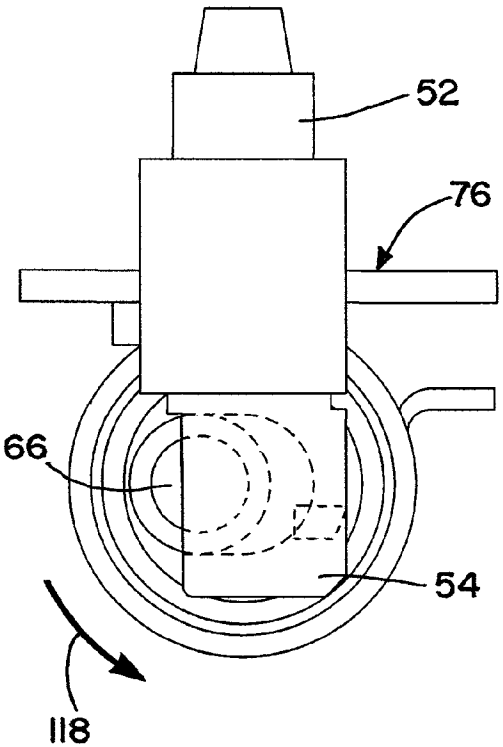

The unlocking process is illustrated in FIGS. 10, 11, and 12A-12E. FIGS. 10 and 11 show the latch mechanism 40 in a locked condition, with the interface shaft 104 of the retaining device 100 cooperating with the bearing 110 to hold the latch ring 76 in place. The tang 94 at the end of the spring leg portion 92 of the latch ring 76 in turn engages the heel 74 of the cam 70 portion of the camshaft 46 in its locked position. The camshaft 46 in turn, via the cam pin 66 and its engagement with the aperture 64 of the base portion 52 of the locking piston 34, holds the piston portion 52 of the locking piston 34 in locked engagement with the recess 32 of the fin lock bracket 30. When the interface shaft 104 is rotated in the direction of arrow 114 to present the flat 106 and thus a reduced diameter to the bearing 110, the latch ring 76 is rotated in the direction of arrow 116 by the force applied by the torsion springs 72 acting through respective cams 70 on the respective tangs 94 and spring leg portions 92 of the latch ring 76. As the cams 70 rotate in the direction of arrow 118, the eccentric cam pins 66 act on the base portions 52 of the locking pistons 34 to retract the base portions 52 which in turn retract the piston portions 54 of the locking pistons 34 through engagement of the shoulders 60 of the base portions 54 with the snap rings 62 of the piston portions 52. The piston portions 52 thus are withdrawn from the recesses 32 in the fin lock brackets 30. The control fins 20 thus are simultaneously released from their locked positions and are free to rotate to provide controllable missile flight.

Figure 14:
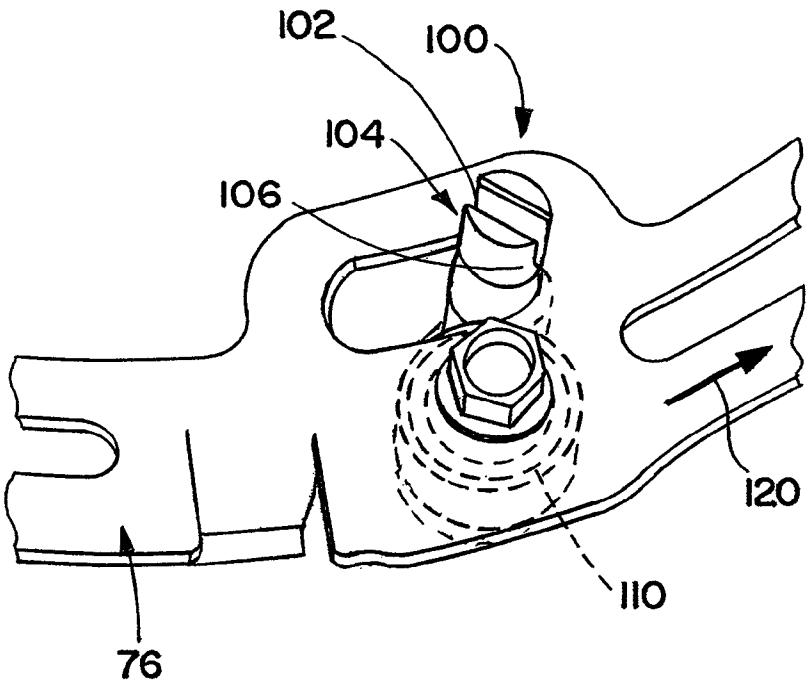
FIG. 14 is a perspective view of a retaining device portion of the latch mechanism portion of the fin lock assembly in an unlocked condition.
Figure 13:
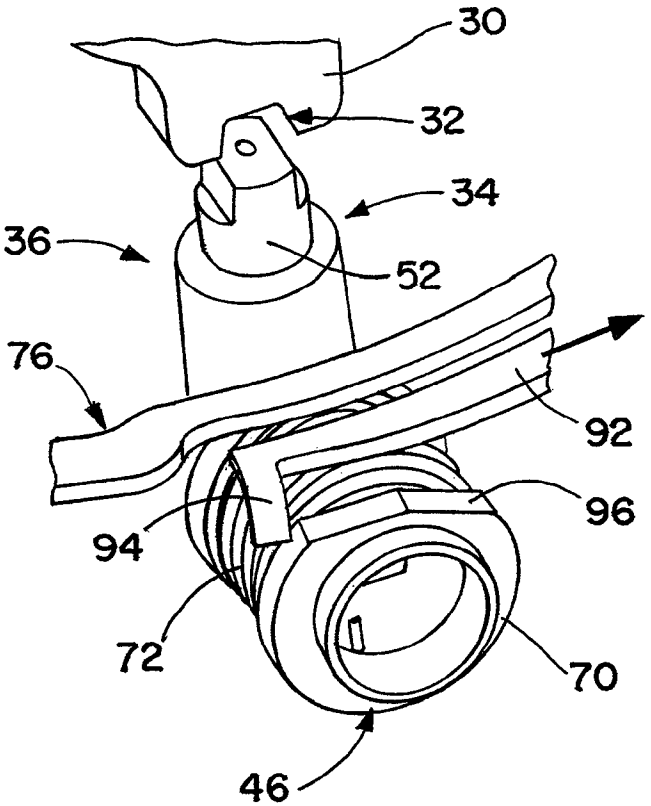
FIG. 13 is a perspective view of a portion of the fin lock assembly in an unlocked condition.

The process of resetting the fin lock assembly 12 will be described with reference to FIGS. 13, 14, and 15A-15F. The resulting unlocked position of the latch ring 76, the locking piston 34, and the camshaft 46 is shown in FIGS. 13 and 14. In the unlocked position, the cam 70 has rotated to present the flat surface 96 to the tang 94 of the spring leg portion 92 of the latch ring 76. To reset the fin lock assembly 12, the latch ring 76 is rotated in the direction of arrow 120, moving the bearing 110 past the interface shaft 104 in the slot 102. The latch ring 76 can be rotated manually, assisted by a torsion spring, or can be rotated by a motive device (not shown).

Once past the bearing 110, the interface shaft 104 is rotated, either manually or by the motive device 112 (FIG. 4), to increase its effective diameter. This generally is accomplished by rotating the flat 106 of the interface shaft 104 away from facing the bearing 110. This locks the latch ring 76 in place in its locked position. Now the piston lock assembly 36 has to be reset.

The process of resetting the piston lock assembly 36 is shown in FIGS. 15A-15F. When the latch ring 76 is returned to the locked position, the tang 94 of the spring leg portion 92 moves over the flat surface 96 of the cam 70. The cam 70 then is rotated, counterclockwise in the illustrated embodiment, which rotates the camshaft 46, including the eccentric cam pin 66, which in turn returns the locking piston 34 to its locked position. A tool is typically inserted through the housing 42 (FIG. 3) of the fin lock assembly 12 to engage the camshaft 46 and rotate it to its locked position. During this process, the control fin 20 (FIG. 2) must be held in a fixed position to align the recess 32 in the fin lock bracket 30 for receipt of the locking piston 34. This could be accomplished with the fin lock assembly 12 mounted in the missile body 14, or the fin lock assembly 12 can be removed from the missile body 14 to be reset and then reinstalled such that the locking piston 34 engage the recesses 32 in the fin lock brackets 30 as the fin lock assembly 12 is inserted.

Figure 15C:
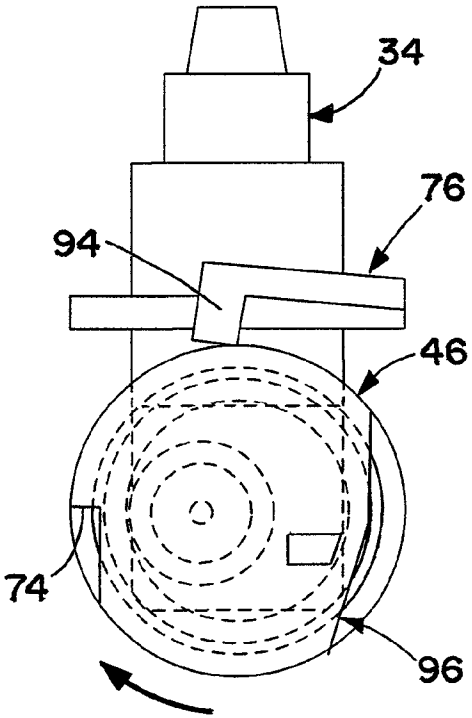
FIGS. 15A-15F are sequential cross-sectional views of the fin lock assembly as it is reset from an unlocked condition to a locked condition.
Figure 15B:
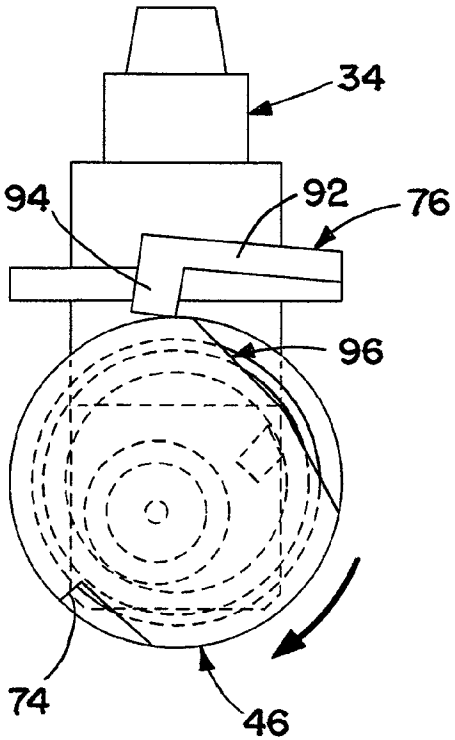
Figure 15A:
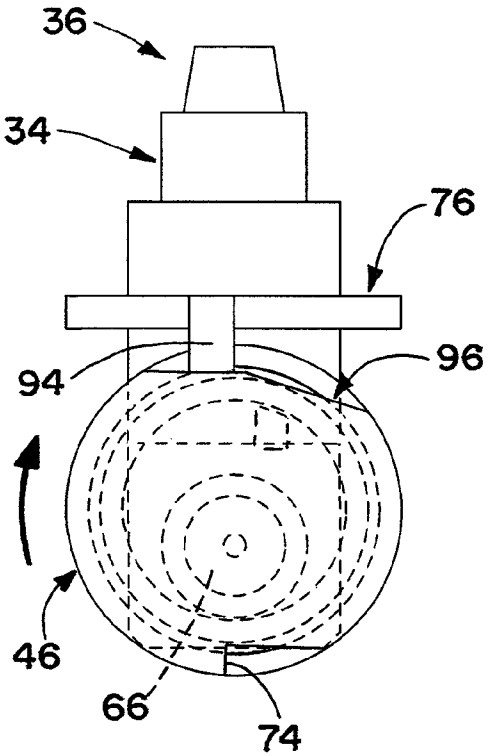
Figure 15F:
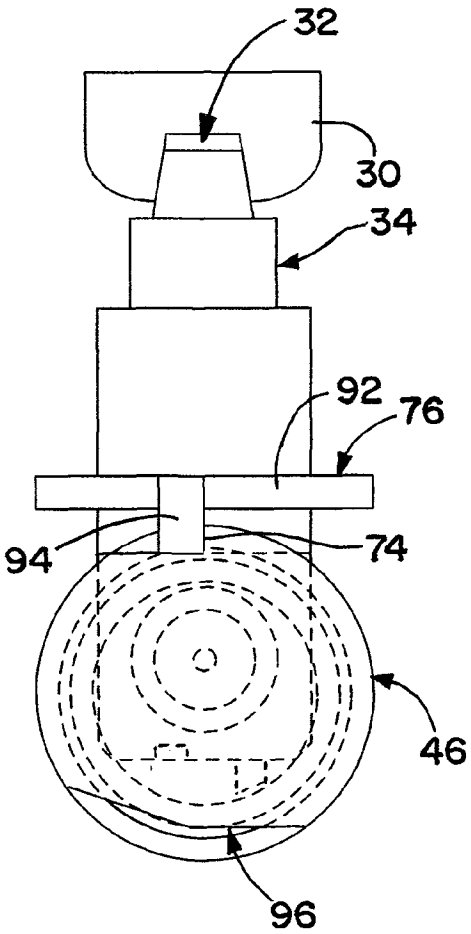
Figure 15E:
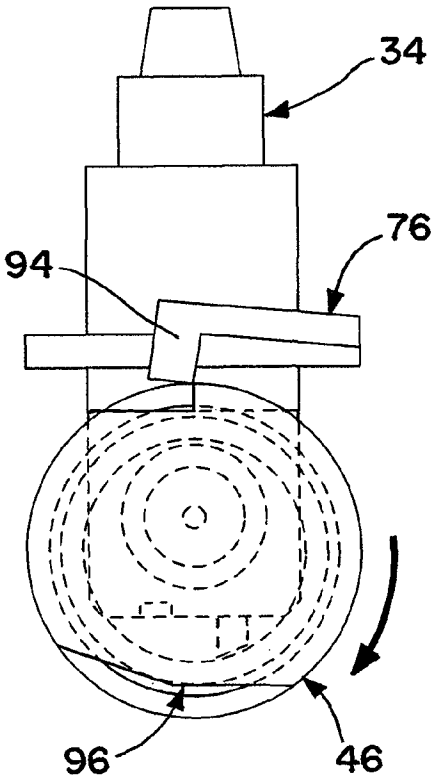
Figure 15D:
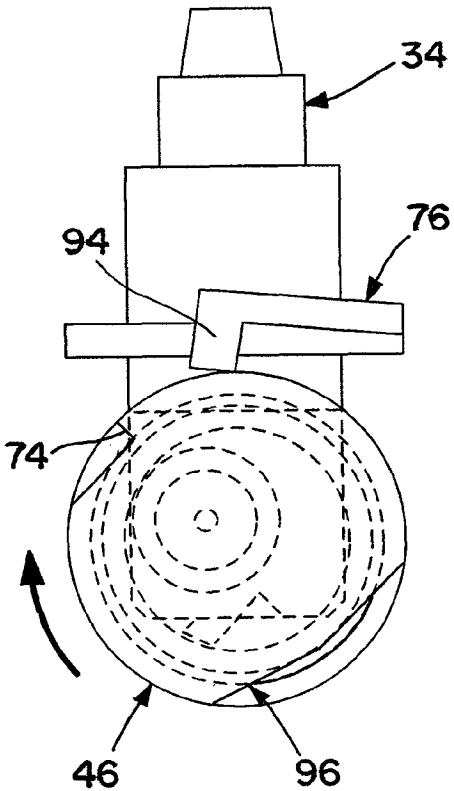

As the camshaft 46 is rotated, reloading the torsion spring 72, the tang 94 of the spring leg portion 92 of the latch ring 76 rides over the continuous outer surface of the cam 70. As the tang 94 transitions off the flat surface 96, the outer surface of the cam 70 pushes the spring leg 92 out of the plane of the ring portion 90 of the latch ring 76. When the notch that forms the heel 74 rotates past the tang 94, the spring leg portion 92 returns to the plane of the ring portion 90 and the tang 94 enters the notch, where the heel 74 engages the tang 94. Rotating the cam 70 also rotates the camshaft 46 and the eccentric cam pin 66, which causes the locking piston 34 to return to its locked position, as shown in FIG. 15F, which also shows the camshaft 46 in the locked position.

In the locked position, the torsion spring 72 biases the heel 74 of the cam 70 against the tang 94. The tang 94, and more generally the latch ring 76, holds the camshaft 46 in its locked position, through engagement of the heel 74 with the tang 94.

In contrast to pyrotechnic fin locking mechanisms, none of the fin lock assembly 12 components has to be replaced to reset it. The fin lock assembly 12 provided by the invention can be easily actuated and reset, repeatedly, facilitating testing and thereby increasing confidence in the reliability of its operation. In addition, it can allow missiles to be stored longer without concern for its continued reliability. Any doubts can be resolved quickly and easily by activating and resetting the fin lock assembly 12 at any time.

If the missile 10 (FIG. 1) is mounted on an exterior surface of an aircraft, the missile is subject to aerodynamic forces acting on the fins 20 from weather and the aircraft's flight and maneuvers. Keeping the fins 20 in a locked condition until the missile 10 is ready to launch or launched protects the actuating devices that control rotation of the fins 20 from those forces. The fin lock assembly 12 provided by the invention holds the fins 20 in their locked position while also isolating the unlocking elements from any forces transmitted from the fins 20 to the fin lock assembly 12 that might tend to unlock the fins 20. Those forces typically would be along the axis 44 of the locking piston 34, but those forces acting on the fin lock assembly 12 provided by the invention cannot act in a direction that would tend to force the locking piston 34 to release the fin 20 from its locked position. Moreover, the spring 56 interposed in the two-part locking piston 34 can absorb any forces that are imparted to the locking piston 34 without allowing the locking piston 34 to escape the recess 32 in the fin lock bracket 30. The camshaft 46 and the torsion spring 72 act by rotating about the cam axis 50, which is transverse the piston axis 44, and are not influenced by forces applied to the locking piston 34. Additionally, the camshaft 46 is held in its locked position by the latch ring 76, which in turn is held in its locked position by the interface shaft 104. Neither the camshaft 46 nor the latch ring 76 nor the interface shaft 104 is influenced by any forces acting on the locking piston 34. Consequently, retracting the locking piston 34 is neither harder nor easier when a force is applied along the axis 44 of the locking piston 34.

While prior designs used pyrotechnic devices for their ability to provide a lot of fast-acting power in a small package, the present invention uses an arrangement of mechanical elements that can provide the same or faster speed of action with lower force, while also providing a system that can be repeatedly activated and reset. This is particularly helpful for testing proper operation of the fin lock assembly. Pyrotechnic fin lock mechanisms cannot be reset without providing additional explosive material, and so are not easily tested. The fin lock assembly provided by the present invention also is significantly cheaper to construct than previous pyrotechnic fin lock mechanisms.

Additionally, although in the present invention a generally planar latch ring is used to direct a piston into a recess coupled to the output shaft, an alternative arrangement uses a cylindrical latch ring or a geared ring to rotate the camshafts in unison and a piston arranged to extend through an opening in the missile body to engage the fin itself. Such an arrangement may be desirable to accommodate different available volumes within the missile body or to obtain more leverage on the missile fin.

In summary, the present invention provides a fin lock assembly 12 for locking and unlocking missile fins 20 that includes a piston 34 that is movable along a piston axis 44 between a locked position for preventing a fin 20 from rotating and an unlocked position for allowing the fin 20 to rotate. The fin lock assembly 12 further includes a camshaft 46 that is rotatable between a locked position and a relatively-rotated unlocked position about a cam axis 50 that is transverse the piston axis 44. The camshaft 46 has an eccentric portion 66 that is connected to the piston 34 such that rotation of the camshaft 46 between the locked position and the unlocked position moves the piston 34 between its corresponding locked position and unlocked position. The fin lock assembly 12 also includes a torsion spring 72 connected to the camshaft 46 to bias the camshaft 46 toward its unlocked position. A latch mechanism 100 holds a plurality of camshafts 46 in their locked positions and simultaneously releases the camshafts 46 to release their fins 20.

Although the invention has been shown and described with respect to a certain illustrated embodiment, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the illustrated embodiment of the invention.

We claim:

1. A fin lock assembly for locking and unlocking rotatable missile fins, comprising a piston lock assembly that includes: a piston movable along a piston axis between a locked position for preventing a fin from rotating and an unlocked position for allowing the fin to rotate; a camshaft rotatable between a locked position and a relatively-rotated unlocked position about a cam axis that is transverse the piston axis, the camshaft having an eccentric cam pin portion connected to the piston such that rotation of the camshaft between the locked position and the unlocked position moves the piston between its corresponding locked position and unlocked position; and a torsion spring connected to the camshaft to bias the camshaft toward its unlocked position, the fin lock assembly further comprising a latch mechanism for releasably holding the camshaft in its locked position.

2. A fin lock assembly as set forth in claim 1, where the piston is coupled to a cam follower connected to the eccentric cam pin portion of the camshaft.

3. A fin lock assembly as set forth in claim 2, where the cam follower has a C-shape that defines an aperture in which is received the eccentric cam pin portion of the camshaft.

4. A fin lock assembly as set forth in claim 1, comprising a housing for supporting the piston lock assembly and the latch mechanism.

5. A fin lock assembly as set forth in claim 4, where the torsion spring is connected to the camshaft on one end and to the housing on an opposing end.

6. A fin lock assembly as set forth in claim 5, where the latch mechanism includes a rotatable member that engages the camshaft to hold it in its locked position and a releasable retaining device for preventing rotation of the rotatable member.

7. A fin lock assembly as set forth in claim 6, where the retaining device includes an eccentric shaft extending into a slot in the rotatable member, the eccentric shaft being rotatable between a locked position that prevents rotation of the rotatable member and an unlocked position that allows rotation of the rotatable member.

8. A fin lock assembly as set forth in claim 6, where the rotatable member is rotatable about an axis that is parallel to one of the piston axis and the cam axis.

9. A missile, comprising a plurality of movable fins; and a fin lock assembly as set forth in claim 1 having a plurality of piston lock assemblies, each piston lock assembly being associated with a corresponding fin, where when the piston of each piston lock assembly is in the locked position the piston is connected to the corresponding fin to prevent movement of the fin; and the latch mechanism configured for releasably holding and simultaneously releasing the camshaft of each piston lock assembly from the camshaft's locked position.

10. A missile as set forth in claim 9, where the missile has a longitudinal missile axis, the latch mechanism includes a rotatable member, and the rotatable member is rotatable about the missile axis.

11. A missile as set forth in claim 9, where the missile includes a body, the fin lock assembly is contained within the body of the missile.

12. A missile as set forth in claim 9, where the piston axis is parallel to the missile axis.

13. A fin lock assembly for locking and unlocking rotatable missile fins, comprising: a plurality of piston lock assemblies and a latch mechanism, the piston lock assembly including a piston movable along a piston axis between a locked position for preventing a fin from rotating and an unlocked position for allowing the fin to rotate, and a camshaft rotatable about a cam axis transverse the piston axis between a locked position and a relatively-rotated unlocked position, the piston including a piston portion for interfering with the rotation of the fin and a base portion for connecting the piston portion to the camshaft, the camshaft having an eccentric pin at a distal end that is connected to the base portion of the piston such that rotation of the camshaft between the locked position and the unlocked position moves the piston between its corresponding locked position and unlocked position, the camshaft further including a torsion spring connected to the camshaft to bias the camshaft toward its unlocked position, a proximal end of the camshaft having a radial notch that forms a shoulder on one side and a relieved portion on an opposite side; and the latch mechanism includes a rotatable latch member having a spring leg with a tang on a distal end of the spring leg that engages the shoulder of the camshaft to hold the camshaft in its locked position, a circumferential slot that receives an eccentric control shaft, the circumferential slot having a locked portion and an unlocked portion separated by a restriction, the control shaft being rotatable between a locked position where the control shaft cannot pass the restriction and an unlocked position where control shaft can pass the restriction and thereby allow the rotatable member to rotate, whereupon the torsion spring of each camshaft simultaneously rotates both a corresponding camshaft and collectively rotates the rotatable member, whereupon rotation of the camshaft moves the corresponding piston to its unlocked position, simultaneously freeing all of the control fins to operate.

* * * * *